US009074550B2

(12) United States Patent
Kojima

(10) Patent No.: US 9,074,550 B2
(45) Date of Patent: Jul. 7, 2015

(54) FUEL INJECTION CONTROL SYSTEM FOR INTERNAL COMBUSTION ENGINE

(75) Inventor: Susumu Kojima, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 346 days.

(21) Appl. No.: 13/814,759

(22) PCT Filed: Oct. 27, 2010

(86) PCT No.: PCT/JP2010/069101

§ 371 (c)(1),
(2), (4) Date: Feb. 7, 2013

(87) PCT Pub. No.: WO2012/056534

PCT Pub. Date: May 3, 2012

(65) Prior Publication Data

US 2013/0138327 A1 May 30, 2013

(51) Int. Cl.

| | |
|---|---|
| ***F02D 41/32*** | (2006.01) |
| ***F02D 41/30*** | (2006.01) |
| ***F02D 41/38*** | (2006.01) |
| *F02D 41/34* | (2006.01) |
| *F02D 41/14* | (2006.01) |

(52) U.S. Cl.

CPC ..... *F02D 41/3005* (2013.01); *F02D 41/3854* (2013.01); *F02D 2041/1409* (2013.01); *F02D 2250/02* (2013.01); *F02D 41/3845* (2013.01)

(58) Field of Classification Search

CPC .... F02M 37/08; F02M 37/10; F02D 41/3005; F02D 41/3854; F02D 41/32; F02D 41/34

USPC ..... 701/103, 101, 102, 104, 105, 114; 123/693–696, 495, 500–504, 497, 509

See application file for complete search history.

(56) References Cited

U.S. PATENT DOCUMENTS

| | | | | |
|---|---|---|---|---|
| 8,820,299 | B2 * | 9/2014 | Kojima | 123/457 |
| 2011/0162622 | A1 | 7/2011 | Kojima et al. | |

FOREIGN PATENT DOCUMENTS

| | | |
|---|---|---|
| JP | 2005 76568 | 3/2005 |
| JP | 2006 322401 | 11/2006 |
| JP | 2007 126986 | 5/2007 |
| JP | 2010 71224 | 4/2010 |

OTHER PUBLICATIONS

International Search Report Issued Dec. 28, 2010 in PCT/JP10/069101 Filed Oct. 27, 2010.

* cited by examiner

*Primary Examiner* — Mahmoud Gimie

(74) *Attorney, Agent, or Firm* — Oblon, McClelland, Maier & Neustadt, L.L.P.

(57) ABSTRACT

An object of the invention is to provide a technology that enables to make the feed pressure as low as possible without inviting a misfire or a deviation of the air-fuel ratio, in a fuel injection control system for an internal combustion engine equipped with a low pressure fuel pump and a high pressure fuel pump. According to the invention, to achieve the object, in a fuel injection control system for an internal combustion engine in which fuel discharged from a low pressure fuel pump is supplied to a fuel injection valve with its pressure boosted by a high pressure fuel pump, while a lowering process of lowering feed pressure or the discharge pressure of a the low pressure fuel pump, the lowering process is suspended and restarted with reference to the tendency of change in an integral term used in a proportional-integral control of the duty cycle of the high pressure fuel pump.

19 Claims, 8 Drawing Sheets

FUEL INJECTION CONTROL SYSTEM FOR INTERNAL COMBUSTION ENGINE

TECHNICAL FIELD

The present invention relates to a fuel injection control system for an internal combustion engine equipped with a low pressure fuel pump (or feed pump) and a high pressure fuel pump (or supply pump).

BACKGROUND ART

For use in a type of internal combustion engine in which fuel is injected directly into a cylinder, there has been known a fuel injection control system equipped with a low pressure fuel pump for sucking fuel from a fuel tank and a high pressure fuel pump for boosting the pressure of the fuel sucked by the low pressure pump to a pressure that allows injection into the cylinder.

In the above-described fuel injection control system, it is desired in order to reduce energy consumption in the operation of the low pressure fuel pump that the discharge pressure (or feed pressure) of the low pressure fuel pump be made as low as possible. However, if the pressure in a section between the low pressure fuel pump and the high pressure fuel pump becomes lower than the saturation vapor pressure of the fuel, vapor might be generated in the high pressure fuel pump.

As a countermeasure against this, Patent Document 1 describes a technology in which when the duty cycle of the high pressure fuel pump becomes equal to or larger than a predetermined value, the feed pressure is raised on the assumption that vapor is generated.

Patent Document 2 discloses a technology applied to a system in which the rate of change in the fuel pressure in a fuel pipe is obtained and a presumption of the generation of fuel vapor is made based on the rate of change thus obtained. In this system, the target fuel pressure is increased when it is presumed that vapor is generated, and the target fuel pressure is decreased when it is presumed that vapor is not generated.

Patent Document 3 discloses a technology in which whether or not fuel vapor will be generated while the engine is shut down is predicted based on the ambient air temperature and the alcohol concentration in the fuel, and when the generation of vapor is predicted, the fuel pressure is raised upon shutting down the engine.

Patent Document 4 discloses a technology in which it is determined whether or not vapor is likely to be generated based on the concentration of vaporized fuel in the gas supplied to an internal combustion engine by a vaporized fuel processing apparatus, and if it is determined that vapor is likely to be generated, the discharge flow rate of a fuel pump is increased.

PRIOR ART DOCUMENT

Patent Document

Patent Document 1: Japanese Patent Application Laid-Open No. 2010-071224

Patent Document 2: Japanese Patent Application Laid-Open No. 2005-076568

Patent Document 3: Japanese Patent Application Laid-Open No. 2006-322401

Patent Document 4: Japanese Patent Application Laid-Open No. 2007-126986

DISCLOSURE OF THE INVENTION

Problem to be Solved by the Invention

In the system described in the aforementioned Patent Document 1, when the duty cycle of the high pressure fuel pump is not lower than a certain value, there is a possibility that a large amount of vapor is generated. The generation of a large amount of vapor leads to a decrease in the fuel pressure in the high pressure fuel passage. Consequently, a misfire and/or a deviation of the air-fuel ratio might be unavoidable.

The present invention has been made in view of the above-described situation, and an object thereof is to provide a technology that enables to make the feed pressure as low as possible without inviting a misfire or a deviation of the air-fuel ratio, in a fuel injection control system for an internal combustion engine equipped with a low pressure fuel pump and a high pressure fuel pump.

Means for Solving the Problem

In the present invention, to solve the above-described problem, we focused on the behavior of an integral term (I term) used in a proportional-integral control in a fuel injection control system for an internal combustion engine in which the duty cycle of a high pressure fuel pump is proportional-integral controlled (PI-controlled) based on the difference between the discharge pressure of a high pressure pump and a target pressure.

Specifically, according to the present invention, there is provided a fuel injection control system for an internal combustion engine in which fuel discharged from a low pressure fuel pump is supplied to a fuel injection valve with its pressure boosted by a high pressure fuel pump, comprising:

a processing section that executes a lowering process of lowering feed pressure that is the discharge pressure of said low pressure fuel pump;

a pressure sensor that measures the discharge pressure of said high pressure fuel pump;

a control section that performs a proportional-integral control of the duty cycle of said high pressure fuel pump based on the difference between a target discharge pressure of said high pressure fuel pump and a measurement value of said pressure sensor;

a stopping section that stops said lowering process with reference to a tendency of change in an integral term used in the proportional-integral control during the execution of said lowering process.

The inventor of the present invention had conducted experiments and verifications strenuously to find that in the case where the duty cycle of the high pressure fuel pump is feedback-controlled by a proportional-integral control, the integral term in the proportional-integral control exhibits an increasing tendency at the time when vapor starts to be generated, in other words at the time when a small amount of vapor is generated.

The aforementioned integral term also exhibits an increasing tendency when the fuel injection quantity increases and when the fuel temperature rises. However, the cause of a change in the integral term during the execution of the lowering process can be considered to be the generation of vapor.

Therefore, according to the present invention, it is possible to stop the process of lowering the feed pressure, before a large amount of vapor is generated to invite a misfire and/or a deviation of the air-fuel ratio. For example, the stopping section may be adapted to stop the lowering process when the integral term in the proportional-integral control exhibits an increasing tendency during the execution of the lowering process. Consequently, the feed pressure can be lowered to an extent that does not lead to the generation of a large amount of vapor. Furthermore, since the present invention does not require a pressure sensor or a temperature sensor provided in the fuel line between the low pressure fuel pump and the high pressure fuel pump, a simplification of the fuel injection control system can be achieved.

The processing section according to the present invention may adapted to keep the feed pressure unchanged or to increase the feed pressure when the lowering process is stopped by the stopping section. This will keep the amount of generated vapor within a range in which a misfire or a deviation of the air-fuel ratio does not occur or will decrease the amount of generated vapor.

The processing section according to the present invention may be adapted to make the feed pressure higher when the change in the integral term is large than when it is small. The change in the integral term is larger when the amount of generated vapor is large than when it is small. Therefore, by making the feed pressure higher when the change in the integral term is large than when it is small, the amount of generated vapor can be decreased more reliably.

In the lowering process according to the present invention, the rate of lowering of the feed pressure may be changed in relation to a parameter indicative of an operation condition of the internal combustion engine. The likelihood of the generation of vapor during the execution of the lowering process changes in relation to the operation condition of the internal combustion engine. The rate of lowering of the feed pressure may be made lower in an operation condition in which vapor is likely to be generated than in an operation condition in which vapor is unlikely to be generated. This enables to lower the feed pressure while preventing a situation in which the amount of generated vapor increases rapidly from occurring.

As the aforementioned parameter indicative of the operation condition, the engine load or a parameter correlating with the fuel temperature may be used. Vapor is more likely to be generated when the engine load is high than when it is low. Therefore, the rate of lowering of the feed pressure may be made lower when the engine load is high than when it is low. Vapor is more likely to be generated when the fuel temperature is high than when it is low. Therefore, the rate of lowering of the feed pressure may be made lower when the fuel temperature is high than when it is low. As the parameter correlating with the fuel temperature, the intake air temperature, the temperature of cooling water, the temperature of lubricant oil or the absolute value of the aforementioned integral term may be used.

Advantageous Effect of the Invention

According to the present invention, the feed pressure can be made as low as possible without inviting a misfire or a deviation of the air-fuel ratio in a fuel injection control system for an internal combustion engine equipped with a low pressure fuel pump and a high pressure fuel pump.

THE BEST MODE FOR CARRYING OUT THE INVENTION

In the following, specific embodiments of the present invention will be described with reference to the drawings. The dimensions, materials, shapes and relative arrangements etc. of the components that will be described in connection with the embodiments are not intended to limit the technical scope of the present invention only to them, unless particularly stated.

Embodiment 1

Figure 1:
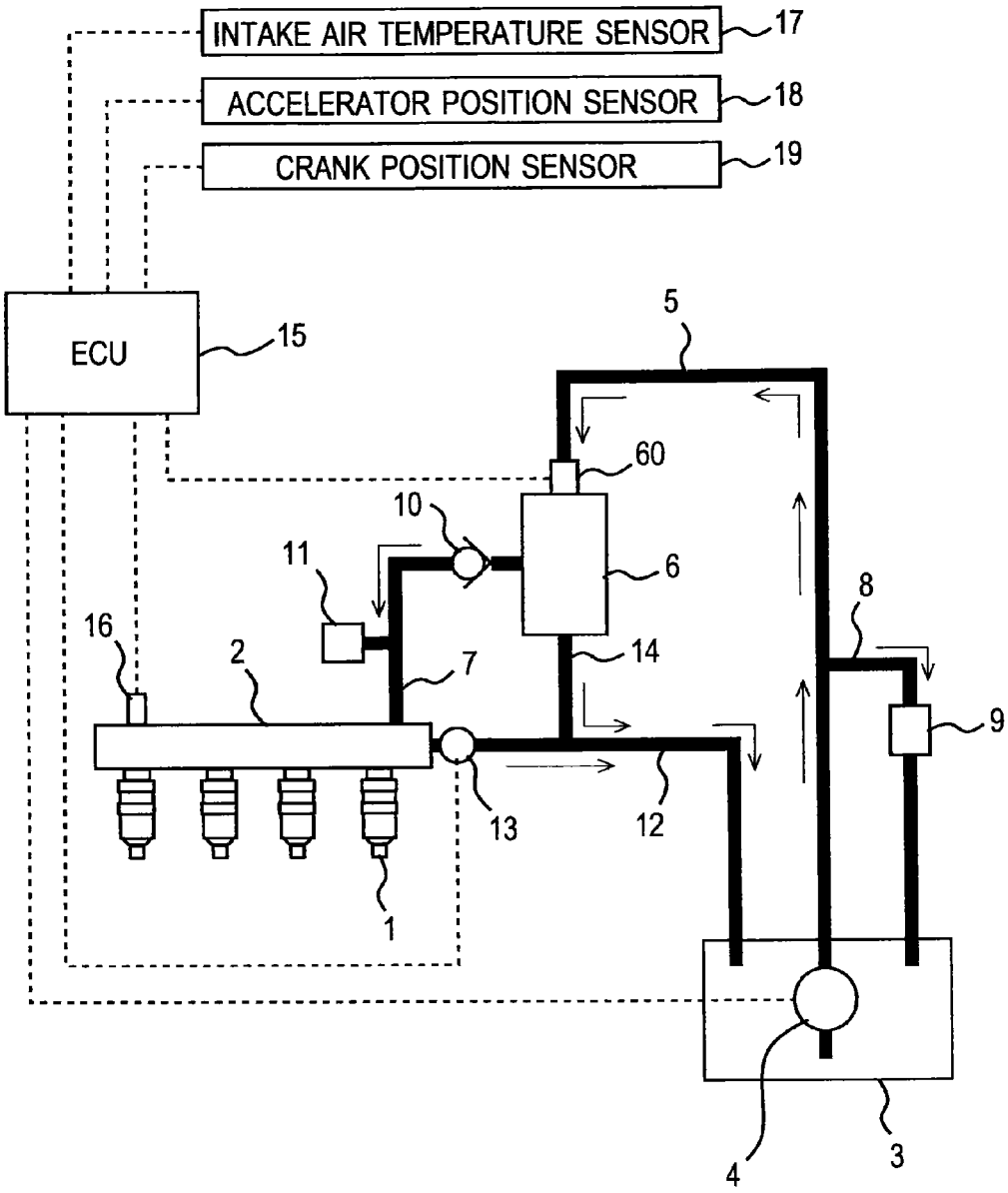
FIG. 1 is a diagram showing the basic configuration of the fuel injection system of an internal combustion engine to which the present invention is applied.

Firstly, a first embodiment of the present invention will be described with reference to FIGS. 1 to 4. FIG. 1 is a diagram showing the basic configuration of a fuel injection control system for an internal combustion engine. In FIG. 1, the fuel injection control system has fuel injection valves 1 for injecting fuel into cylinders of the internal combustion engine. The fuel injection valves 1 are connected to a delivery pipe 2. Although four fuel injection valves 1 are connected to the delivery pipe in the case illustrated in FIG. 1, the number of fuel injection valves 1 may be five or more or three or less.

The fuel injection control system has a low pressure fuel pump 4 that pumps up fuel stored in a fuel tank 3. The low pressure fuel pump 4 is a rotary pump that is driven by an electric motor. Low pressure fuel discharged from the low pressure fuel pump 4 is delivered to an inlet port of a high pressure fuel pump 6 through a low pressure fuel passage 5.

The high pressure fuel pump 6 is a reciprocating pump (plunger pump) that is driven by the power of the internal combustion engine (e.g. by means of rotational force of a cam shaft). An inlet valve 60 for switching between opening and closing of the inlet port is provided at the inlet port of the high pressure fuel pump 6. The inlet valve 60 is an electromagnetic valve mechanism that changes the discharge rate of the high pressure fuel pump 6 by changing the opening/closing timing relative to the position of the plunger. To the discharge port of the high pressure pump 6 is connected the base end of a high pressure fuel passage 7. The terminal end of the high pressure fuel passage 7 is connected to the aforementioned delivery pipe 2.

To the middle of the aforementioned low pressure fuel passage 5 is connected the base end of a branch passage 8. The terminal end of the branch passage 8 is connected to the fuel tank 3. A pressure regulator 9 is provided in the middle of the branch passage 8. The pressure regulator 9 is adapted to open when the pressure (fuel pressure) in the low pressure fuel passage 5 exceeds a predetermined value, thereby returning surplus fuel in the low pressure fuel passage 5 to the fuel tank 3 through the branch passage 8.

A check valve 10 and a pulsation damper 11 are provided in the middle of the high pressure passage 7. The check valve 10 is a one way valve that allows the flow from the discharge port of the aforementioned high pressure fuel pump 6 toward the aforementioned delivery pipe 2 and restricts the flow from the aforementioned delivery pipe 2 toward the discharge port of the aforementioned high pressure fuel pump 6. The pulsation damper 11 is used to damp the pulsation of fuel caused with the operation (i.e. sucking and discharging) of the aforementioned high pressure fuel pump 6.

To the aforementioned delivery pipe 2 is connected a return passage 12 for returning surplus fuel in the delivery pipe 2 to the aforementioned fuel tank 3. A relief valve 13 for switching between opening and closing of the return passage 12 is provided in the middle of the return passage 12. The relief valve 13 is an electric or electromagnetic valve mechanism that is opened when the fuel pressure in the delivery pipe 2 exceeds a target value.

To the middle of the aforementioned return passage 12 is connected the terminal end of a communication passage 14. The base end of the communication passage is connected to the aforementioned high pressure fuel pump 6. The communication passage 14 lets surplus fuel discharged from the aforementioned high pressure fuel pump 6 flow into the return passage 12.

The fuel injection control system has an electronic control unit (ECU) 15 that controls the above-described components. The ECU 15 is electrically connected with various sensors such as a fuel pressure sensor 16, an intake air temperature sensor 17, an accelerator position sensor 18, and a crank position sensor 19.

The fuel pressure sensor 16 is a sensor that outputs an electrical signal correlating with the fuel pressure in the delivery pipe 2. The fuel pressure sensor 16 may be provided in the high pressure fuel passage 7. The intake air temperature sensor 17 outputs an electrical signal correlating with the temperature of air taken into the internal combustion engine. The accelerator position sensor 18 outputs an electrical signal correlating with the amount of operation of the accelerator pedal (or the accelerator opening degree). The crank position sensor 19 is a sensor that outputs an electrical signal correlating with the rotational position of the output shaft (or crankshaft) of the internal combustion engine.

The ECU 15 controls the low pressure fuel pump 4 and the inlet valve 60 based on signals output from the above-described various sensors. For instance, the ECU adjusts the opening/closing timing of the inlet valve 60 in such a way that the output signal of the fuel pressure sensor 16 (i.e. the actual fuel pressure) converges to a target value. In doing so, the ECU 15 performs a proportional-integral control (PI control) of the duty cycle (i.e. the ratio of the energized period and the non-energized period in a solenoid) as a control quantity of the inlet valve 60 based on the difference between the actual fuel pressure and a target value. The aforementioned target value is determined as a function of the desired fuel injection quantity through the fuel injection valve 1.

In the above-described proportional-integral control, the ECU 15 calculates the duty cycle by adding a control value (or feed forward term) determined in relation to the desired fuel injection quantity, a control value (or proportional term) determined in relation to the difference between the actual fuel pressure and the target value (which will be hereinafter referred to as the "fuel pressure difference") and a control value (or integral term) obtained by integrating a part of the difference between the actual fuel pressure and the target value. This calculation of the duty cycle by the ECU 15 embodies the control section according to the present invention.

The relationship between the aforementioned fuel pressure difference and the feed forward term and the relationship between the aforementioned fuel pressure difference and the proportional term shall be determined in advance by an adaptation process based on an experiment etc. The proportion of a portion of the aforementioned fuel pressure difference to be added to the integral term shall also be determined in advance by an adaptation process based on an experiment etc.

The ECU 15 executes a lowering process in which the ECU 15 lowers the discharge pressure of the low pressure fuel pump 4 (or feed pressure) in order to reduce the power consumption in the low pressure fuel pump 4 as much as possible. Specifically, the ECU 15 lowers the discharge pressure of the low pressure fuel pump 4 by a constant step (which will be hereinafter referred to as the "lowering coefficient"). If the discharge pressure of the low pressure fuel pump 4 falls steeply, there is a possibility that the pressure of the fuel in the low pressure fuel passage 5 will become much lower than the saturation vapor pressure of the fuel. If this occurs, a large amount of vapor will be generated in the low pressure fuel passage 5, and a suction failure or discharge failure will be caused in the high pressure fuel pump 6. In view of this, it is desirable that the aforementioned lowering coefficient be set to be as high as possible so long, as the fuel pressure in the low pressure fuel passage 5 is not made much lower than the saturation vapor pressure. It is desirable that the lowering coefficient be obtained in advance by an adaptation process such as an experiment.

When the fuel pressure in the low pressure fuel pump 5 becomes lower than the saturation vapor pressure of the fuel, it is desirable that the discharge pressure of the low pressure fuel pump 4 be raised. One method of achieving this may be providing a sensor for measuring the fuel pressure in the low pressure fuel passage 5 and a sensor for determining the saturation vapor pressure of the fuel and raising the discharge pressure of the low pressure fuel pump 4 when the fuel pressure in the low pressure fuel passage 5 becomes lower than the saturation vapor pressure. However, this method will encounter a problem that a deterioration in the vehicle mountability and an increase in the manufacturing cost will result due to an increase in the number of parts in the fuel injection control system.

In view of the above, in the lowering process in this embodiment, the discharge pressure of the low pressure fuel pump 4 is adjusted based on the tendency of change in the integral term used in calculating the duty cycle of the high pressure fuel pump 6.

Figure 2:
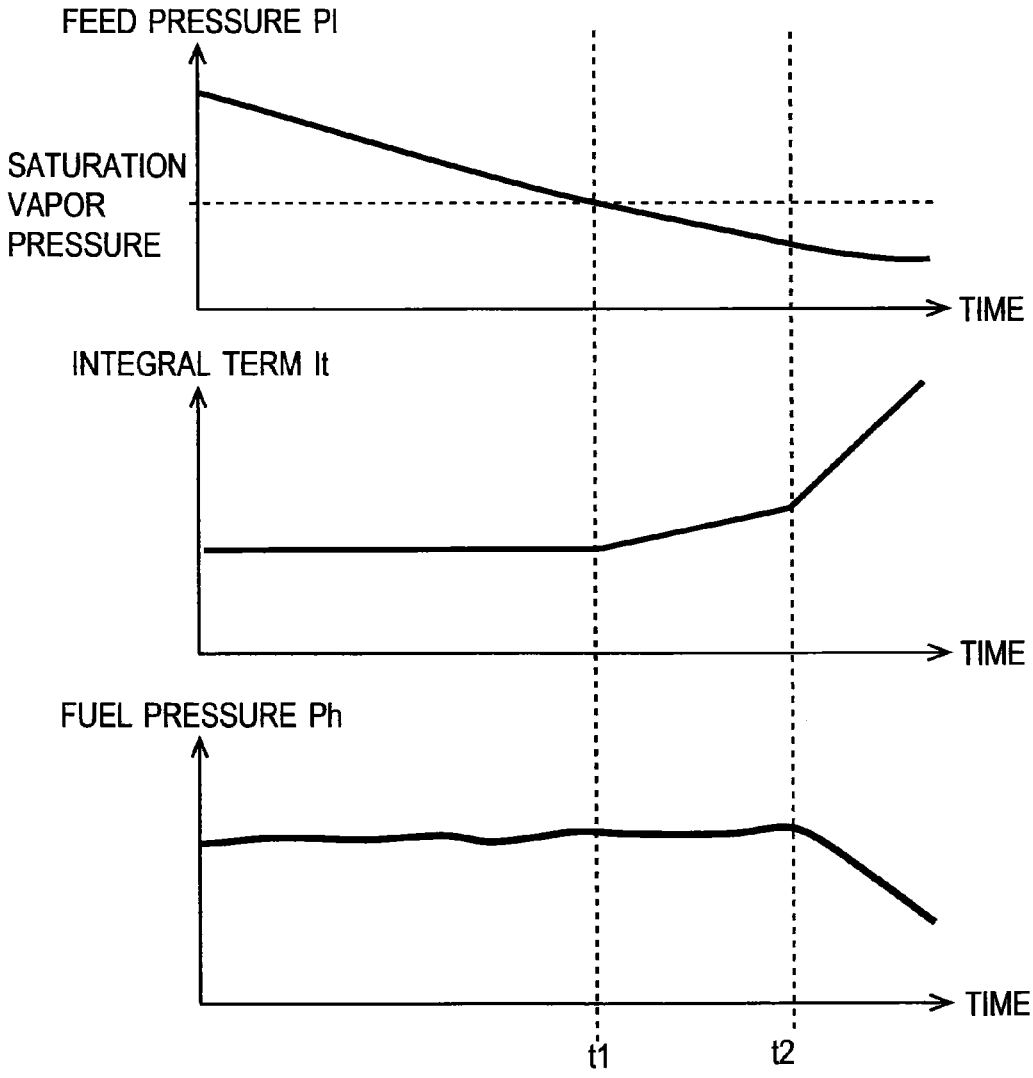
FIG. 2 shows the behavior of an integral term It and the fuel pressure Ph in a high pressure fuel passage with decrease in the discharge pressure Pl of a low pressure fuel pump (or feed pressure).

FIG. 2 shows the behavior of the integral term It and the fuel pressure Ph in the high pressure fuel passage 7 with continuous decrease in the discharge pressure Pl of the low pressure fuel pump 4 (or feed pressure). In FIG. 2, as the feed pressure Pl becomes lower than the saturation vapor pressure (at t1 in FIG. 2), the integral term It exhibits a moderate increasing tendency. With a further decrease in the feed pressure Pl, a suction failure or a discharge failure occurs in the high pressure fuel pump 6 (at t2 in FIG. 2). When a suction failure or a discharge failure occurs in the high pressure fuel pump 6, the increasing rate of the integral term It becomes higher and the fuel pressure Ph in the high pressure fuel passage 7 decreases.

A consideration of the relationship shown in FIG. 2 may suggest increasing the discharge pressure of the low pressure fuel pump 4 when the magnitude (or absolute value) of the integral term It exceeds a threshold value. However, the value of the integral term It increases not only with the generation of vapor but also with a rise in the fuel temperature and/or an increase in the desired injection quantity.

Therefore, in order to detect the generation of vapor more correctly, it is preferred that the discharge pressure of the low pressure fuel pump 4 be adjusted based on the tendency of change in the integral term It per certain time period (for example, per execution cycle of the lowering process or per cycle of calculation of the duty cycle of the high pressure fuel pump 6). A preferable method is, for example, lowering the discharge pressure of the low pressure fuel pump 4 when the integral term It is constant or in a decreasing tendency and raising the discharge pressure of the low pressure fuel pump 4 when the integral term It is in an increasing tendency. This method enables detecting the generation of vapor before a suction failure or a discharge failure occurs in the high pressure fuel pump 6 (for example in the period from t1 to t2 in FIG. 2).

Figure 3:
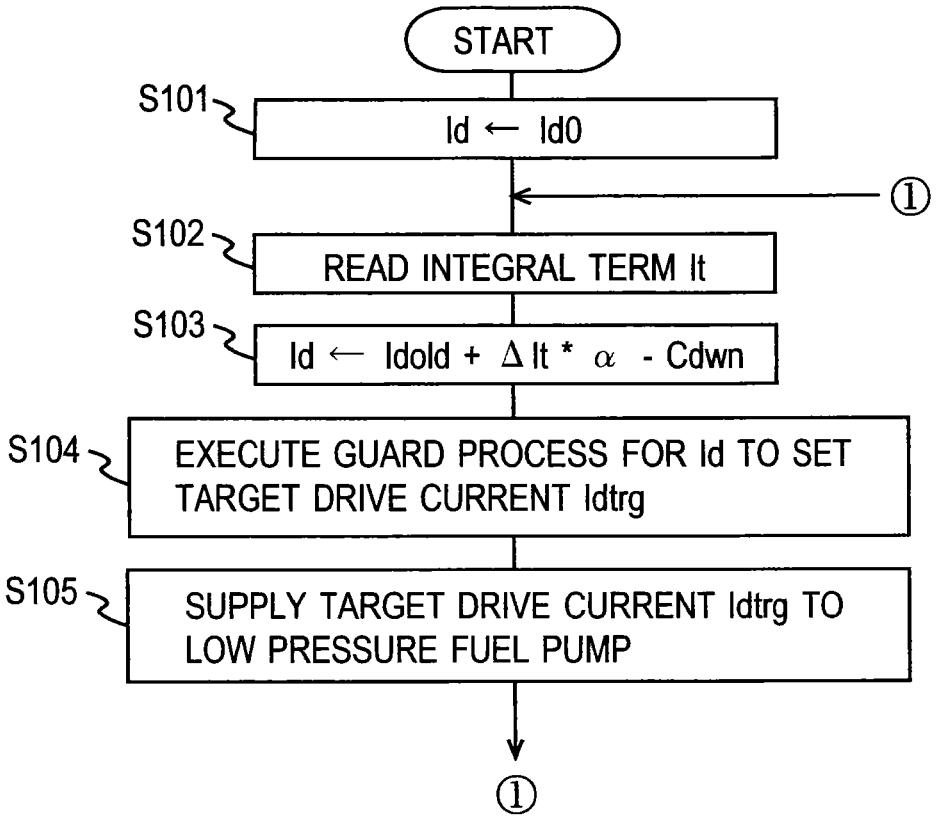
FIG. 3 is a flow chart of a lowering process routine in a first embodiment.

In the following, a procedure of executing the lowering process in this embodiment will be described with reference to FIG. 3. FIG. 3 is a flow chart of a lowering process routine. The lowering process routine is stored in advance in a ROM of the ECU 15 and the execution of this routine is triggered by the start-up of the internal combustion engine (e.g. when the ignition switch is turned from off to on).

In the lowering process routine shown in FIG. 3, the ECU 15 firstly executes the process of step S101. Specifically, the ECU 15 sets the drive current Id for the low pressure fuel pump 4 to an initial value Id0.

In step S102, the ECU 15 reads the value of the integral term It used in the calculation of the duty cycle of the high pressure fuel pump 6. Then, the ECU calculates the difference ΔIt (=It−Itold) by subtracting the previous integral term Itold from the integral term It read in the above step S102.

In step S103, the ECU 15 calculates the drive current Id for the low pressure fuel pump 4 using the difference ΔIt calculated in the above step S102 and a lowering coefficient Cdwn. Here, the ECU 15 calculates the drive current Id according to the following equation:

$$Id = Id\text{old} + \Delta It * \alpha - C\text{dwn}.$$

In the above equation, α is a moderating coefficient, which is determined in advance by an adaptation process based on an experiment etc.

If the value of the aforementioned difference ΔIt is positive (namely, if the integral term It exhibits an increasing tendency), the drive current Id will increase. In this case, the discharge pressure (or feed pressure) Pl of the low pressure pump 4 will increase. This embodies the stopping section according to the present invention. On the other hand, if the value of the aforementioned difference ΔIt is zero (namely, if the integral term It is constant), or if the value of the aforementioned integral term It is negative (namely, if the integral term It exhibits a decreasing tendency), the drive current Id will decrease. In this case, the discharge pressure Pl of the low pressure fuel pump 4 (or feed pressure) will decrease. This embodies the processing section according to the present invention.

Then in step S104, the ECU 15 executes a guard process with respect to the drive current Id obtained in the above step S103. Specifically, the ECU 15 determines whether or not the drive current Id obtained in the above step S103 is larger than a lower limit value and smaller than an upper limit value. If the drive current Id obtained in the above step S103 is larger than the lower limit value and smaller than the upper limit value, the ECU 15 sets the target drive current Idtrg to the aforementioned drive current Id. If the aforementioned drive current Id is larger than the upper limit value, the ECU 15 sets the target drive current Idtrg to a value equal to the upper limit value. If the aforementioned drive current Id is smaller than the lower limit value, the ECU 15 sets the target drive current Idtrg to a value equal to the lower limit value.

In step S105, the ECU 15 supplies the target drive current Idtrg set in the above step S104 to the low pressure fuel pump 4 to thereby drive the low pressure pump 4. The ECU 15 executes the process of step S102 and the subsequent steps repeatedly after executing the process of step S105.

As described above, with the execution of the lowering process routine shown in FIG. 3 by the ECU 15, the discharge pressure of the lower pressure fuel pump 4 is lowered when the integral term It is constant or exhibits a decreasing tendency (namely, when the value of the difference ΔIt is zero or negative) and raised when the integral term It exhibits an increasing tendency (namely, when the value of the difference ΔIt is positive).

Figure 4:
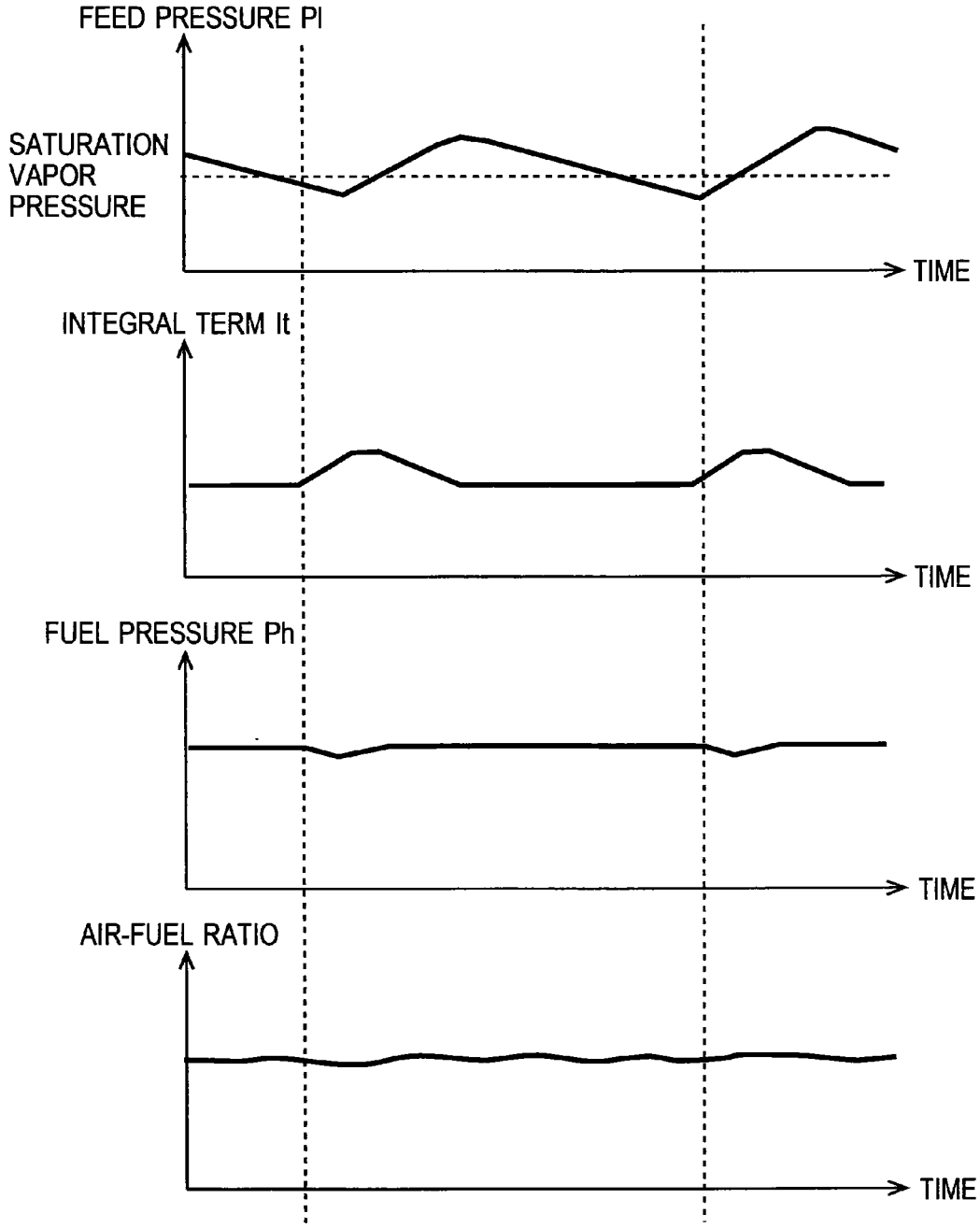
FIG. 4 shows the behavior of the feed pressure Pl, the integral term It, the fuel pressure Ph and the air-fuel ratio while the lowering process is executed in the first embodiment.

Therefore, according to this embodiment, the lowering of the feed pressure Pl can be stopped before a large amount of vapor is generated in the low pressure fuel passage 5 (i.e. at the time when vapor starts to be generated). In consequence, the feed pressure Pl can be lowered as much as possible without leading to a large decrease in the fuel pressure Ph or a deviation of the air-fuel ratio, as shown in FIG. 4. When the lowering of the feed pressure Pl is stopped, the larger the aforementioned difference ΔIt is, the higher the feed pressure Pl will be. Therefore, it is possible to prevent a suction failure and discharge failure in the high pressure fuel pump 6 from occurring more reliably. The lowering process in this embodiment does not need a sensor for measuring the fuel pressure in the low pressure fuel passage 5 or a sensor for determining the saturation vapor pressure of the fuel. Therefore, it does not invite a deterioration in the vehicle mountability of the fuel injection control system or an increase in the manufacturing cost of the system.

Embodiment 2

Next, a second embodiment of the present invention will be described with reference to FIGS. 5 to 8. Here, features that differ from those in the above-described first embodiment will be described, and like features will not be described.

What is different in this embodiment from the above described first embodiment resides in the way of setting the lowering coefficient Cdwn. While in the above-described first embodiment the lowering coefficient Cdwn is set to a constant value, in this embodiment the lowering coefficient is varied in relation to the fuel temperature.

Figure 5:
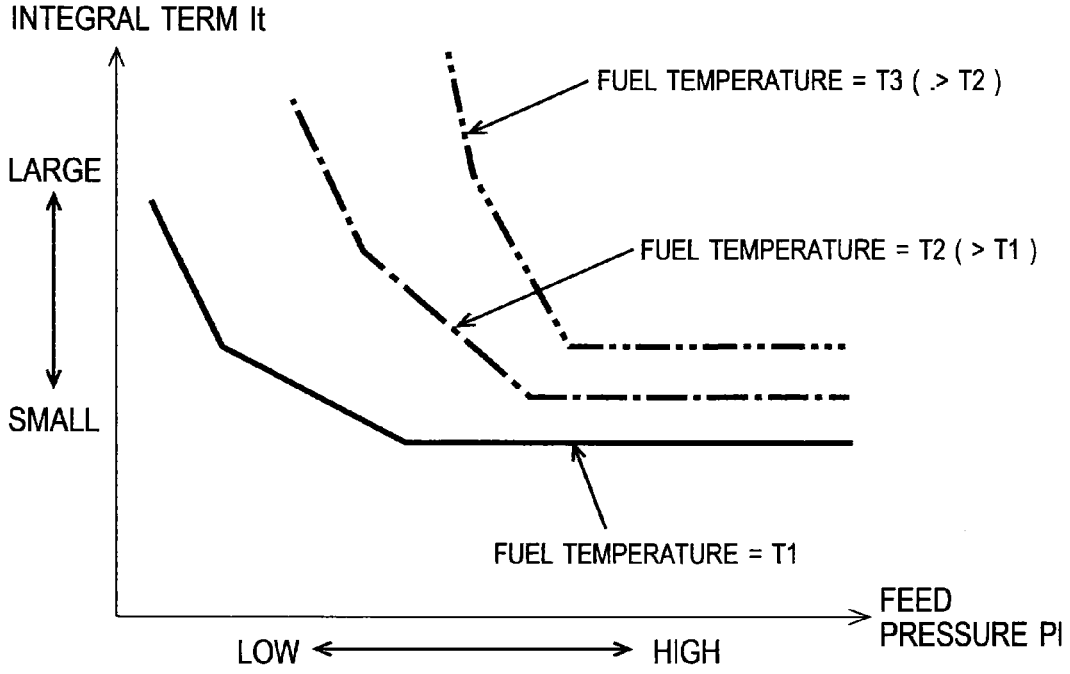
FIG. 5 is a graph showing the relationship between the fuel temperature, the feed pressure Pl and the integral term It.

FIG. 5 is a graph showing the relationship between the feed pressure Pl and the magnitude (or absolute value) of the integral term It. The solid curve in FIG. 5 represents the relationship in a case where the fuel temperature is T1. The alternate long and short dashed curve in FIG. 5 represents the relationship in a case where the fuel temperature is T2 that is higher than the aforementioned temperature T1. The chain double-dashed curve in FIG. 5 represents the relationship in a case where the fuel temperature is T3 that is higher than the aforementioned temperature T2.

As shown in FIG. 5, the magnitude (or absolute value) of the integral term It is larger when the fuel temperature is high than when the fuel temperature is low. In addition, the degree of increase in the integral term It in the case where the feed pressure Pl is lower than the saturation vapor pressure is larger when the fuel temperature is high than when the fuel temperature is low. In consequence, when the fuel temperature is high, the difference between the feed pressure Pl at the time when vapor starts to be generated in the low pressure fuel passage 5 and the feed pressure Pl at the time when a suction failure or discharge failure in the high pressure fuel pump 6 occurs (or when a decrease in the fuel pressure Ph in the high pressure fuel passage 7 occurs) is small.

Figure 6:
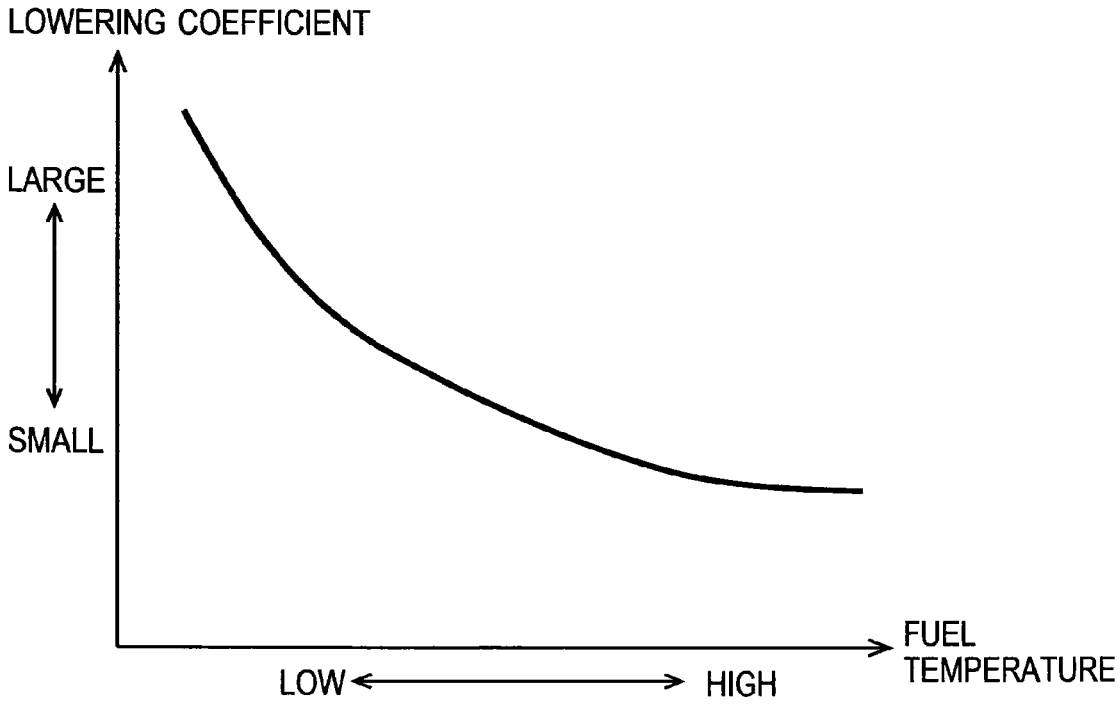
FIG. 6 is a graph showing the relationship between the fuel temperature and the lowering coefficient.

In view of the above, in the lowering process in this embodiment, the value of the lowering coefficient Cdwn is set smaller when the fuel temperature is high than when the fuel temperature is low as shown in FIG. 6. With such a variation in the lowering coefficient Cdwn in relation to the fuel temperature, the rate of decrease in the feed pressure Pl in a certain period becomes lower when the fuel temperature is high than when the fuel temperature is low. In consequence, the feed pressure Pl can be lowered rapidly when the fuel temperature is low, while when the fuel temperature is high the feed pressure Pl can be lowered without a rapid increase in the amount of vapor generated in the low pressure fuel passage 5.

A parameter used as an argument in setting the lowering coefficient Cdwn may be an actually measured value of the fuel temperature, though this requires the low pressure fuel passage 5 to be equipped with a temperature sensor. Alternately, use may be made of the temperature of cooling water circulating in the internal combustion engine, the temperature of lubricant oil in the internal combustion engine, or the signal output from the intake air temperature sensor 17 (i.e. the intake air temperature).

Figure 7:
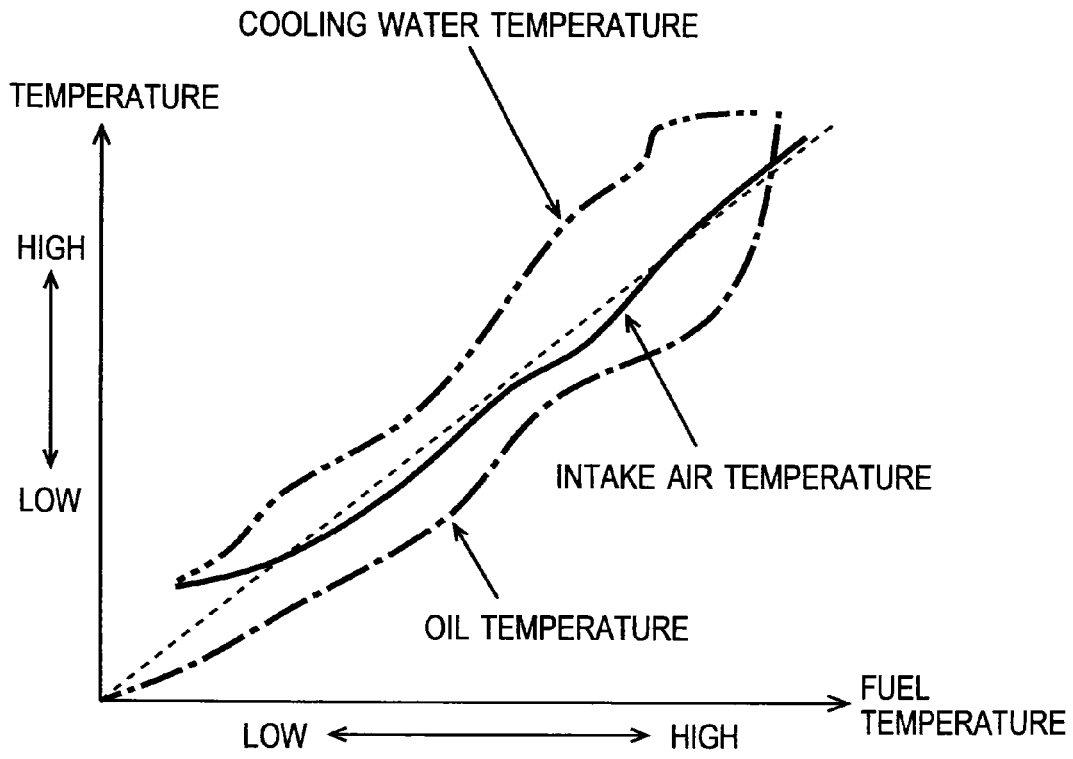
FIG. 7 shows parameters that correlate with the fuel temperature.

FIG. 7 is a graph showing the relationships of the cooling water temperature, the oil temperature and the intake air temperature in relation to the fuel temperature. The solid curve in FIG. 7 represents the intake air temperature. The alternate long and short dashed curve in FIG. 7 represents the temperature of lubricant oil (oil temperature). The chain double-dashed curve in FIG. 7 represents the temperature of cooling water (cooling water temperature).

As shown in FIG. 7, the intake air temperature, the oil temperature and the cooling water temperature change substantially in conformity with the fuel temperature. However, the intake air temperature has a higher correlation with the fuel temperature as compared to the oil temperature and the cooling water temperature. It is considered that this is because the intake air temperature is the temperature measured by the intake air temperature sensor 17 provided in the engine room. More specifically, it is considered that the temperature in the low pressure fuel passage 5 is substantially equal to the temperature in the engine room and that the temperature of air measured by the intake air temperature sensor 17 also is substantially equal to the temperature in the engine room. In view of the above, in this embodiment the signal output from the intake air temperature sensor 17 (i.e. the intake air temperature) is used as a parameter that correlates with the fuel temperature. The above-described relationship between the various temperatures and the fuel temperature might differ depending on the specifications of the internal combustion engine and/or the vehicle. Therefore, a parameter other than the intake air temperature may be used in such cases.

Figure 8:
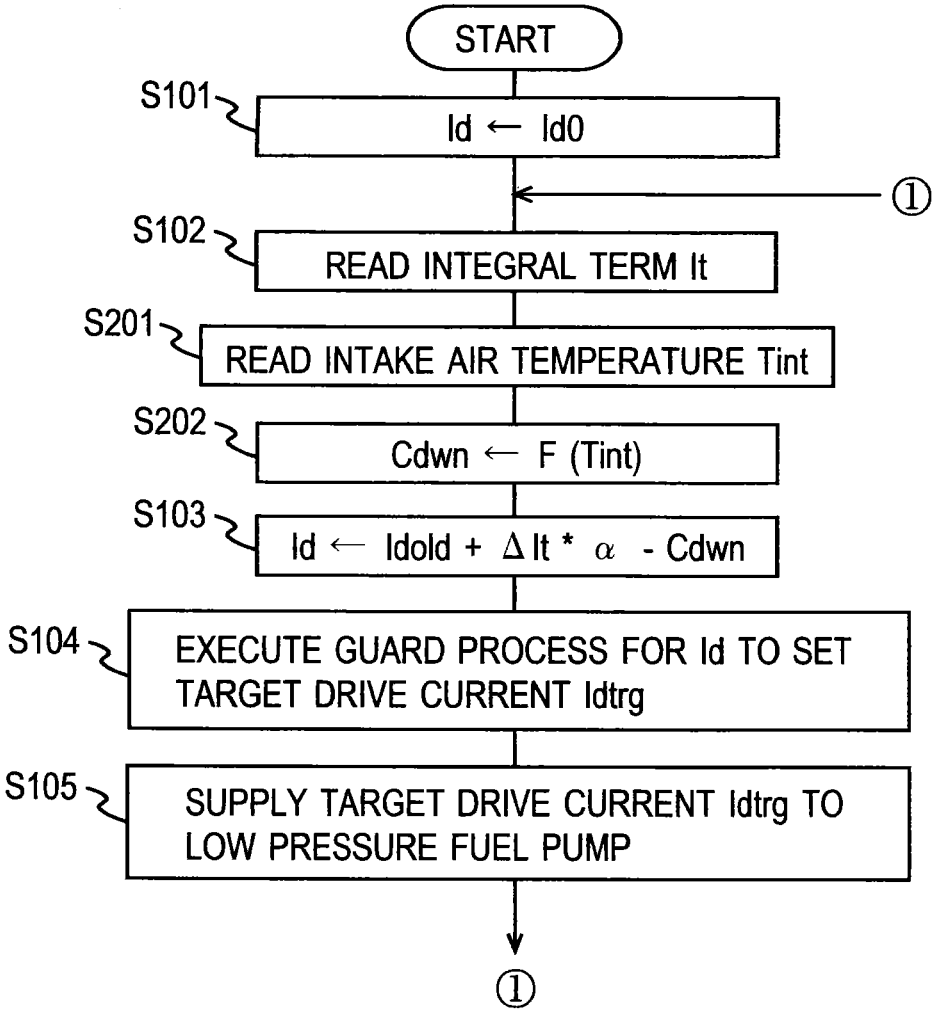
FIG. 8 is a flow chart of a lowering process routine in a second embodiment.

In the following, a procedure of executing the lowering process in this embodiment will be described with reference to FIG. 8. FIG. 8 is a flow chart of a lowering process routine in this embodiment. In FIG. 8, the processes same as those in the lowering process routine in the above-described first embodiment (see FIG. 3) are denoted by the same symbols.

The difference between the lowering process routine in the first embodiment and the lowering process routine in this embodiment resides in that the process of steps S201 and S202 is executed between steps S102 and S103. In step S201, the ECU 15 reads the signal (intake air temperature) Tint output from the intake air temperature sensor 17. Then in step S202, the ECU 15 calculates the lowering coefficient Cdwn (=F(Tint)) using as an argument the intake air temperature Tint read in the above step S201. In this process, the ECU 15 may use a map in which the relationship described with reference to FIG. 6 is specified.

After executing the process of step S202, the ECU 15 proceeds to step S103. In step S103, the ECU 15 calculates the drive current Id for the low pressure fuel pump 4 using the integral term It read in step S102 and the lowering coefficient Cdwn obtained in step S202.

By executing the lowering process according to the lowering process routine shown in FIG. 8, the feed pressure Pl can be lowered as rapidly as possible without inviting a significant decrease in the fuel pressure Ph or a deviation of the air-fuel ratio.

Although in this embodiment the intake air temperature, the cooling water temperature and the oil temperature have been mentioned as parameters that correlate with the fuel temperature, the parameters are not limited to them. For example, since the magnitude (or absolute value) of the integral term It tends to become larger as the fuel temperature becomes higher as described above with reference to FIG. 5, the magnitude (or absolute value) of the integral term It may be used as a parameter to calculate the lowering coefficient Cdwn.

The degree of increase in the integral term It or the likelihood of the generation of vapor in the low pressure fuel passage 5 tends to be high when the load (or accelerator opening degree) and/or the speed of the internal combustion engine is high. Therefore, the load and/or the speed of the internal combustion engine may be used as an argument to calculate the lowering coefficient Cdwn, or the engine load and/or the engine speed and the fuel temperature may be used as arguments to calculate the lowering coefficient Cdwn.

DESCRIPTION OF THE REFERENCE SIGNS

1: fuel injection valve
2: delivery pipe
3: fuel tank
4: low pressure fuel pump
5: low pressure fuel passage
6: high pressure fuel pump
7: high pressure fuel passage
8: branch passage
9: pressure regulator
10: check valve
11: pulsation damper
12: return passage
13: relief valve
14: communication passage
15: ECU
16: fuel pressure sensor
17: intake air temperature sensor
18: accelerator position sensor
19: crank position sensor
60: inlet valve

The invention claimed is:

1. A fuel injection control system for an internal combustion engine in which fuel discharged from a low pressure fuel pump is supplied to a fuel injection valve with its pressure boosted by a high pressure fuel pump, comprising:

a processing section that executes a lowering process of lowering feed pressure that is the discharge pressure of said low pressure fuel pump;

a pressure sensor that measures the discharge pressure of said high pressure fuel pump;

a control section that performs a proportional-integral control of the duty cycle of said high pressure fuel pump based on the difference between a target discharge pressure of said high pressure fuel pump and a measurement value of said pressure sensor;

a stopping section that stops said lowering process with reference to a tendency of change in an integral term used in the proportional-integral control during the execution of said lowering process.

2. A fuel injection control system for an internal combustion engine according to claim 1, wherein said stopping section stops said lowering process when said integral term exhibits an increasing tendency.

3. A fuel injection control system for an internal combustion engine according to claim 2, wherein when said lowering process is stopped by said stopping section, said processing section keeps said feed pressure unchanged or increase said feed pressure.

4. A fuel injection control system for an internal combustion engine according to claim 3, wherein said processing section makes said feed pressure higher when the amount of change in said integral term is large than when it is small.

5. A fuel injection control system for an internal combustion engine according to claim 1, wherein the rate of lowering of the feed pressure in said lowering process is changed in relation to an operation condition of the internal combustion engine.

6. A fuel injection control system for an internal combustion engine according to claim 5, wherein the rate of lowering of the feed pressure in said lowering process is made lower when a temperature parameter that correlates with fuel temperature is high than when it is low.

7. A fuel injection control system for an internal combustion engine according to claim 6, wherein said temperature parameter is at least one of the temperature of cooling water, the temperature of lubricant oil and the temperature of intake air.

8. A fuel injection control system for an internal combustion engine according to claim 5, wherein the rate of lowering of the feed pressure in said lowering process is made lower when the engine load is high than when it is low.

9. A fuel injection control system for an internal combustion engine according to claim 1, wherein the rate of lowering of the feed pressure in said lowering process is made lower when the absolute value of said integral term is large than when it is small.

10. A fuel injection control system for an internal combustion engine according to claim 2, wherein the rate of lowering of the feed pressure in said lowering process is changed in relation to an operation condition of the internal combustion engine.

11. A fuel injection control system for an internal combustion engine according to claim 3, wherein the rate of lowering of the feed pressure in said lowering process is changed in relation to an operation condition of the internal combustion engine.

12. A fuel injection control system for an internal combustion engine according to claim 10, wherein the rate of lowering of the feed pressure in said lowering process is made lower when a temperature parameter that correlates with fuel temperature is high than when it is low.

13. A fuel injection control system for an internal combustion engine according to claim 11, wherein the rate of lowering of the feed pressure in said lowering process is made lower when a temperature parameter that correlates with fuel temperature is high than when it is low.

14. A fuel injection control system for an internal combustion engine according to claim 12, wherein said temperature parameter is at least one of the temperature of cooling water, the temperature of lubricant oil and the temperature of intake air.

15. A fuel injection control system for an internal combustion engine according to claim 13, wherein said temperature parameter is at least one of the temperature of cooling water, the temperature of lubricant oil and the temperature of intake air.

16. A fuel injection control system for an internal combustion engine according to claim 10, wherein the rate of lowering of the feed pressure in said lowering process is made lower when the engine load is high than when it is low.

17. A fuel injection control system for an internal combustion engine according to claim 11, wherein the rate of lowering of the feed pressure in said lowering process is made lower when the engine load is high than when it is low.

18. A fuel injection control system for an internal combustion engine according to claim 2, wherein the rate of lowering of the feed pressure in said lowering process is made lower when the absolute value of said integral term is large than when it is small.

19. A fuel injection control system for an internal combustion engine according to claim 3, wherein the rate of lowering of the feed pressure in said lowering process is made lower when the absolute value of said integral term is large than when it is small.

* * * * *